US007927174B2

(12) United States Patent
Kim et al.

(10) Patent No.: US 7,927,174 B2
(45) Date of Patent: Apr. 19, 2011

(54) VEHICLE WITH CONTROLLED MOTORIZED MOVEMENTS

(75) Inventors: Daniel Kim, Portland, OR (US); Ryan Kratz, Oak Park, IL (US)

(73) Assignee: Rehco, LLC, Chicago, IL (US)

( * ) Notice: Subject to any disclaimer, the term of this patent is extended or adjusted under 35 U.S.C. 154(b) by 141 days.

(21) Appl. No.: 12/541,578

(22) Filed: Aug. 14, 2009

(65) Prior Publication Data

US 2010/0068969 A1 Mar. 18, 2010

Related U.S. Application Data

(60) Provisional application No. 61/089,074, filed on Aug. 15, 2008.

(51) Int. Cl.
*A63H 17/26* (2006.01)
*A63H 17/00* (2006.01)

(52) U.S. Cl. ..... 446/470; 446/321; 446/434; 446/487

(58) Field of Classification Search ..... 446/95, 446/97, 321, 376, 434, 435, 465, 427, 428, 446/487, 489
See application file for complete search history.

(56) References Cited

U.S. PATENT DOCUMENTS

| | | | | |
|---|---|---|---|---|
| 4,599,078 | A * | 7/1986 | Obara | 446/95 |
| 5,052,680 | A * | 10/1991 | Malewicki et al. | 472/137 |
| 5,292,275 | A | 3/1994 | Swisher et al. | |
| 5,310,379 | A | 5/1994 | Hippely et al. | |
| 5,924,910 | A * | 7/1999 | Liu | 446/470 |
| 7,387,558 | B2 * | 6/2008 | Swisher et al. | 446/427 |
| 2001/0044255 | A1 | 11/2001 | Lee et al. | |

FOREIGN PATENT DOCUMENTS

KR 20-0386746 6/2005

* cited by examiner

*Primary Examiner* — Kien T Nguyen
(74) *Attorney, Agent, or Firm* — Adam K. Sacharoff; Much Shelist

(57) ABSTRACT

A toy vehicle is provided having a wheel base, a chassis, and a cab. The wheel base has pairs of rear wheels. The chassis is attached to the wheel base about a horizontal rotational axis which is capable of raising and lowering the chassis from a first position to a second position. The cab is pivotally attached to the chassis such that the cab is able to remain in a substantially horizontal position when the chassis is moved. The cab further includes a pair of joints that secure arms, which have at the end a wheel. The joint enables the arms to move when the chassis moves. When moving the cab, the vehicle transforms between the first and second positions, where the wheels attached to the arms are able to move with the cab.

20 Claims, 19 Drawing Sheets

10

VEHICLE WITH CONTROLLED MOTORIZED MOVEMENTS

CROSS REFERENCE TO RELATED APPLICATIONS

The present application claims priority to U.S. Provisional Application 61/089,074 filed on Aug. 15, 2008.

FIELD OF THE INVENTION

The present invention relates to a vehicle with controlled motorized movements.

BACKGROUND OF THE INVENTION

Conventional vehicles which include the ability to transform from one or more positions are typically manual manipulated vehicles that require various skills and knowledge of the final positions. A need exists for a toy vehicle that includes motorized movements that control and move the vehicle into the various transformation positions.

BRIEF DESCRIPTION OF THE DRAWINGS

A fuller understanding of the foregoing may be had by reference to the accompanying drawings, wherein.

SUMMARY OF THE INVENTION

Figure 1:
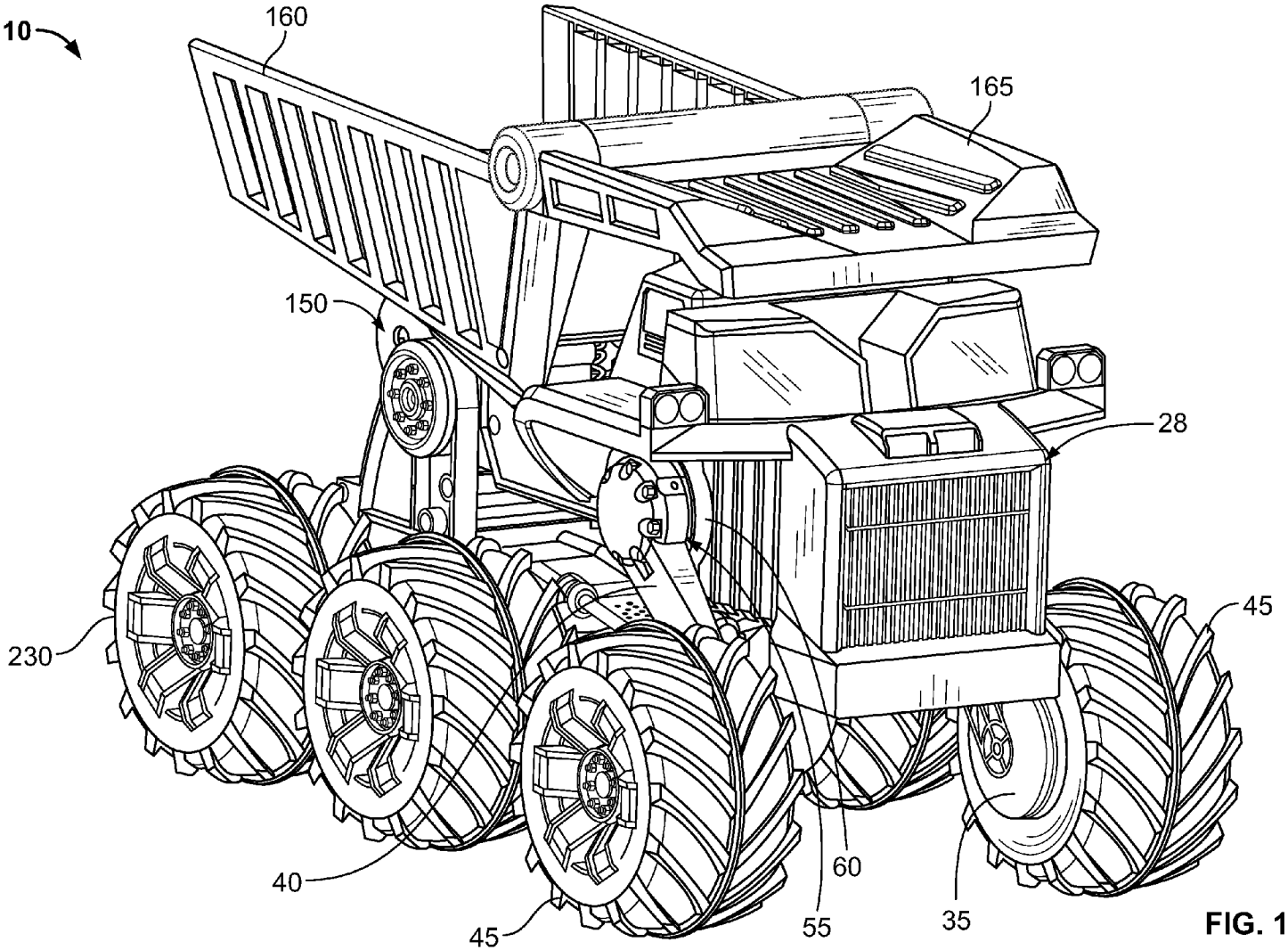
FIG. 1 is a front perspective view of a vehicle in accordance with an embodiment of the present invention.

In one or more of the embodiments of the present invention there is provided, a toy vehicle is provided having a wheel base, a chassis, and a cab. The wheel base has pairs of rear wheels. The chassis is attached to the wheel base about a horizontal rotational axis which is capable of raising and lowering the chassis from a first position to a second position. The cab is pivotally attached to the chassis such that the cab is able to remain in a substantially horizontal position when the chassis is moved. The cab further includes a pair of joints that secure arms, which have at the end a wheel. The joint enables the arms to move when the chassis moves. When moving the cab, the vehicle transforms between the first and second positions, where the wheels attached to the arms are able to move with the cab.

Based thereon other aspects of the invention and other embodiments can be disclosed. For example, there may be provided a toy vehicle having a wheel base assembly having at least two pair of rear rotatable wheels; a chassis assembly rotatably attached to the wheel base assembly about a horizontal rotation axis capable of raising and lowering the chassis assembly from a first position to a second position; and a cab assembly being pivotally attached to the chassis assembly such that the cab assembly remains in a substantially horizontal position when the chassis assembly raises and lowers the cab assembly. The vehicle may further include a pair of arms each having at one end a front rotatable wheel and being attached to the cab assembly at an other end by a means to direct movement of the two arms when the chassis assembly raises and lowers the cab assembly. The raising and lowering the cab assembly transforms the vehicle from the first position defined as a substantially horizontal position with the at least two pair of rear wheels and the front wheels attached to the arms being positioned for rotating on a surface to a second position defined as a position above the horizontal position with the at least two pair of rear wheels being positioned for rotating on a surface and the front wheels attached to the arms being raised above the at least two pair of rear wheels.

In another embodiment there is provided a transforming toy vehicle having multiple configurations including a first configuration and a second configuration. The vehicle includes a cab assembly including a cab pivot mechanism with a means to pivot the cab assembly from a center position to both left and right positions; a wheel base assembly; and a chassis assembly rotatably attached to the wheel base assembly about a chassis pivot mechanism, the chassis pivot mechanism having a means to raise a front portion of the chassis assembly about a chassis pivot axle. The cab pivot mechanism further connecting a rear portion of the cab assembly to the front portion of the of the chassis assembly, the chassis pivot mechanism rotatably connecting a rear portion of the chassis assembly to the wheel base assembly. The first configuration is defined by the chassis assembly and cab assembly positioned in a substantially horizontal position. The vehicle has a means to direct the chassis pivot mechanism to raise the front portion of the chassis assembly while the cab pivot mechanism directs the cab assembly to retain a substantially horizontal position as the front portion of the chassis assembly rises to a position above the horizontal position defining the second configuration. The chassis pivot mechanism and the cab pivot mechanism are in communication with a triggering means. An integrated circuit with electronics is provided for receiving signals generated in response to the triggering means and for controlling movement of the vehicle in response to the signals. The vehicle has a first motor in communication with the triggering means and linked to control movement of the chassis pivot mechanism such that the chassis pivot mechanism moves in response to a first activation of the triggering means. Furthermore, the vehicle has a second motor in communication with the triggering means and linked to control movement of the cab pivot mechanism such that the cab pivot mechanism moves in response to a second activation of the triggering means. The triggering means further includes a third activation to simultaneously direct movement of the chassis pivot mechanism and the cab pivot mechanism.

In yet another embodiment, there is provided a transformation assembly for a toy vehicle that includes a wheel base assembly, a chassis assembly rotatably mounted to the wheel base assembly about a horizontal rotation axis to raise and lower the chassis assembly from a substantially horizontal position to a position above the horizontal position, and a cab assembly pivotally mounted to the chassis assembly wherein the cab assembly is able to remain in a substantially horizontal position upon raising and lowering the chassis assembly. Thus wherein, raising and lowering the cab assembly transforms the vehicle from a first configuration defined by the substantially horizontal position to a second configuration defined by the position above the horizontal position.

Numerous other advantages and features of the invention will become readily apparent from the following detailed description of the invention and the embodiments thereof, from the claims, and from the accompanying drawings.

DETAILED DESCRIPTION OF THE EMBODIMENTS

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention, claims or the embodiments illustrated.

Figure 2A:
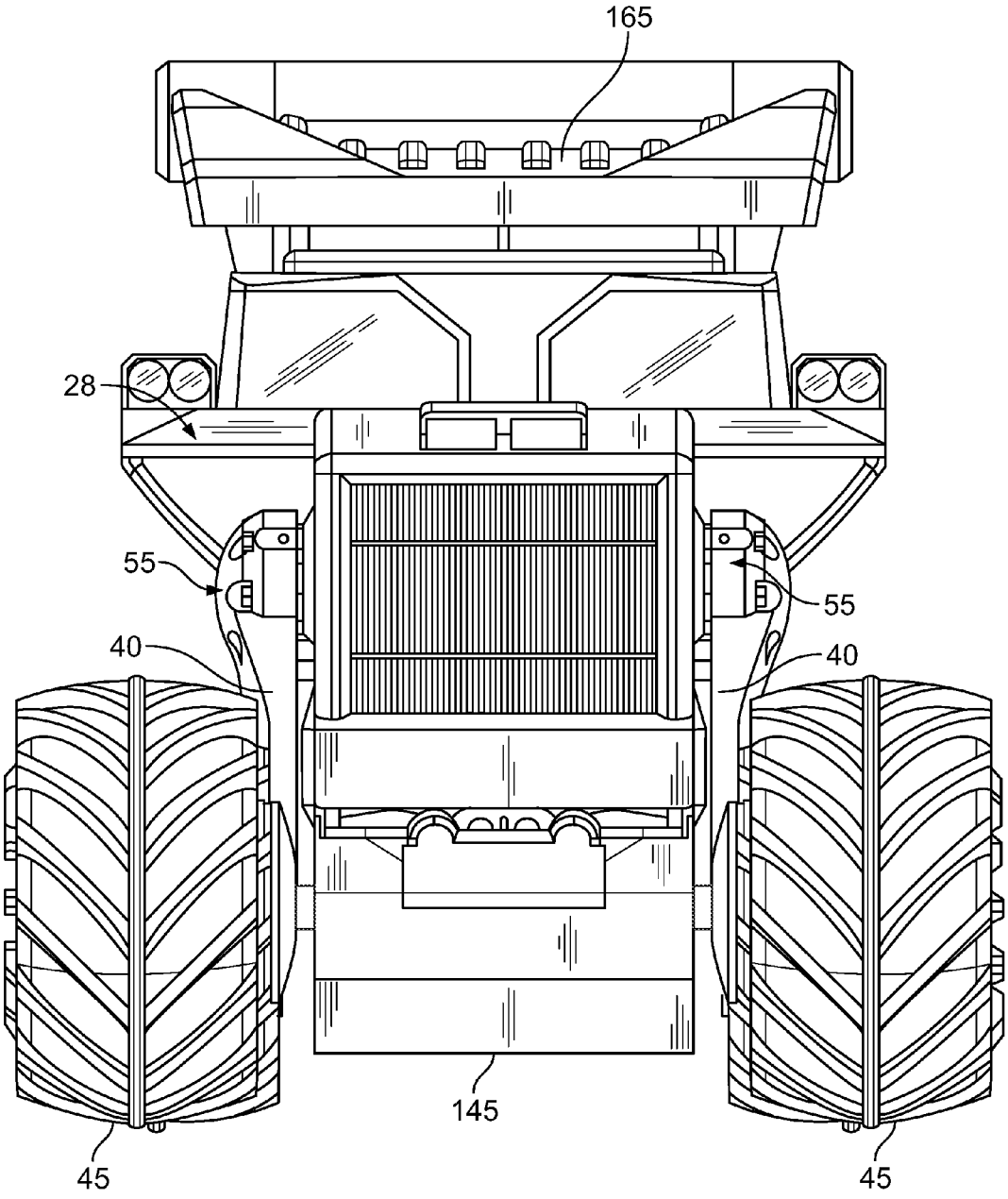
FIG. 2*a* is a front view of FIG. 1.
Figure 2B:
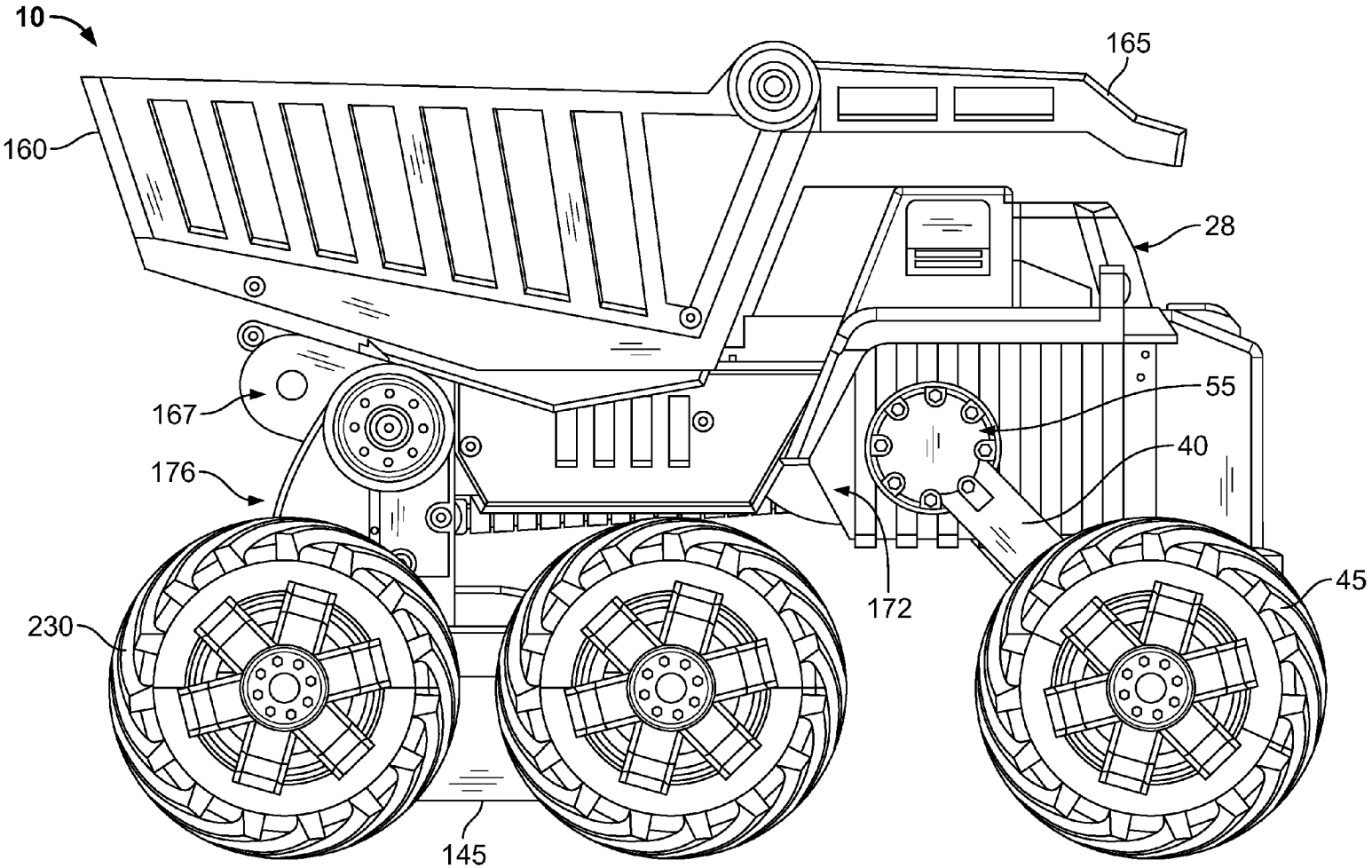
FIG. 2*b* is a side view of FIG. 1.
Figure 2C:
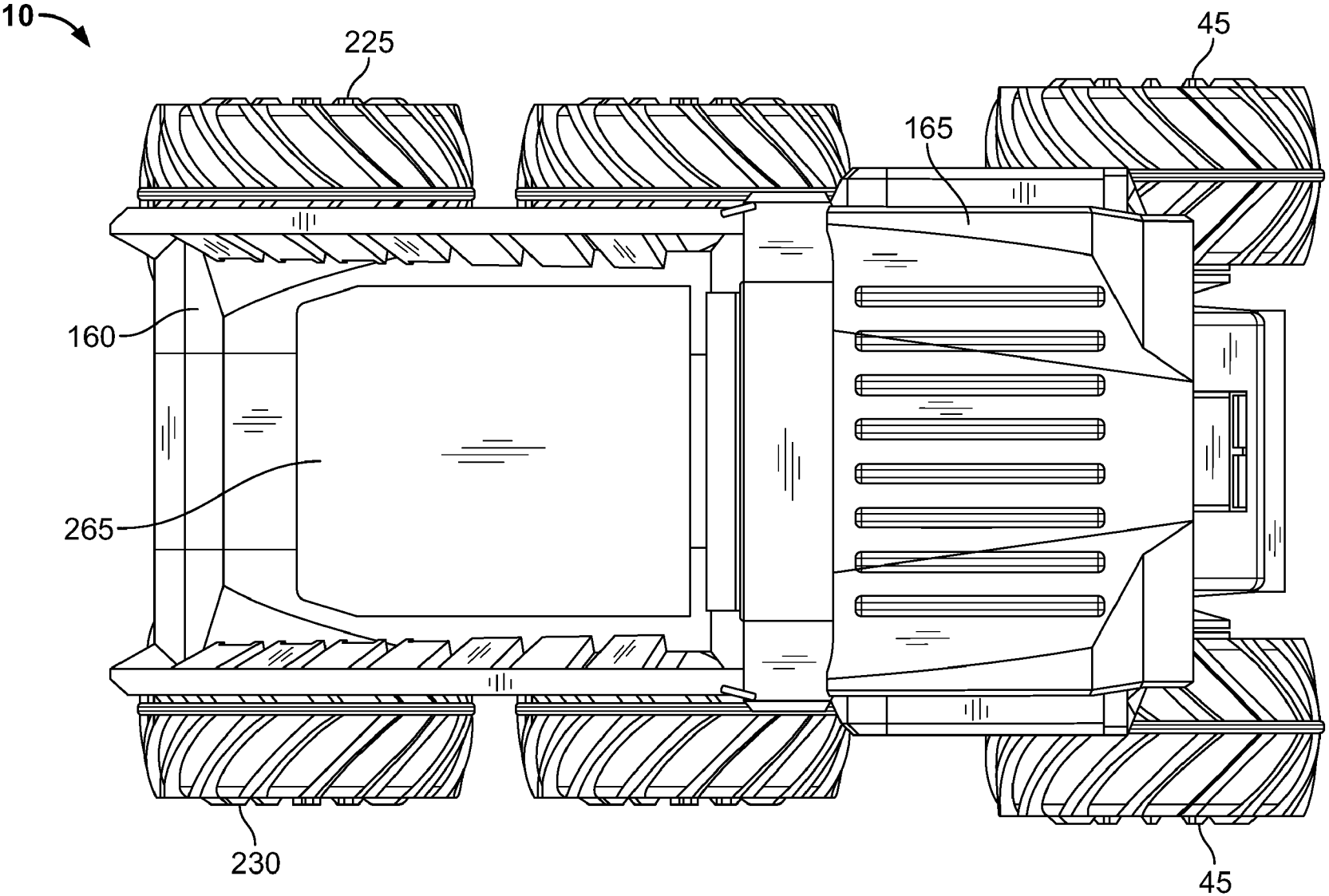
FIG. 2*c* is a top view of FIG. 1.

Referring now to FIGS. 1 through 2*c*, in accordance to an embodiment of the present invention, there is illustrated a vehicle 10 that includes a cab assembly, a chassis assembly and a wheel base assembly. In this embodiment, the vehicle 10 is in the form of a toy dump truck. However, the interactive vehicle 10 may take on several different forms, such as other types of construction vehicles, trucks, or animals. A variety of forms may be used to incorporate the internal mechanics and electronics of the interactive vehicle 10. Utilizing the internal mechanics and electronics (described below), the interactive vehicle may perform a variety of movements and actions in coordination with audio and lights. One such example of these movements is the ability of the vehicle 10 to lower and raise both the cab assembly and the chassis assembly separately or together through a variety of positions. Further, as described in greater detail a plurality of switches may be positioned throughout the vehicle to trigger preprogrammed responses of both movements, sounds, and/or lights.

Figure 3A:
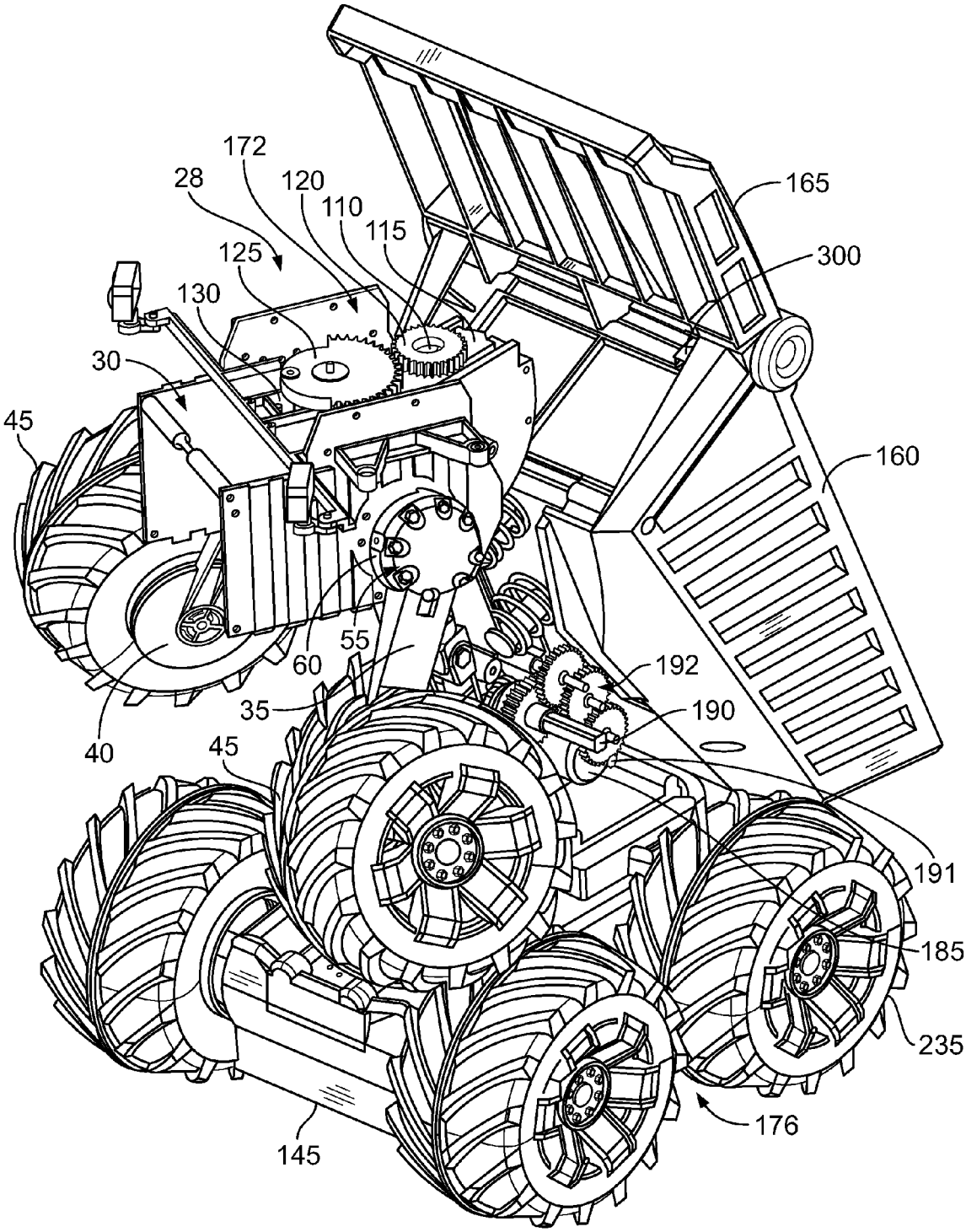
FIG. 3*a* is a side perspective view of the vehicle from FIG. 1 in accordance with one embodiment of the present invention illustrating a partial view of the cab assembly in a position above the horizontal position.
Figure 3B:
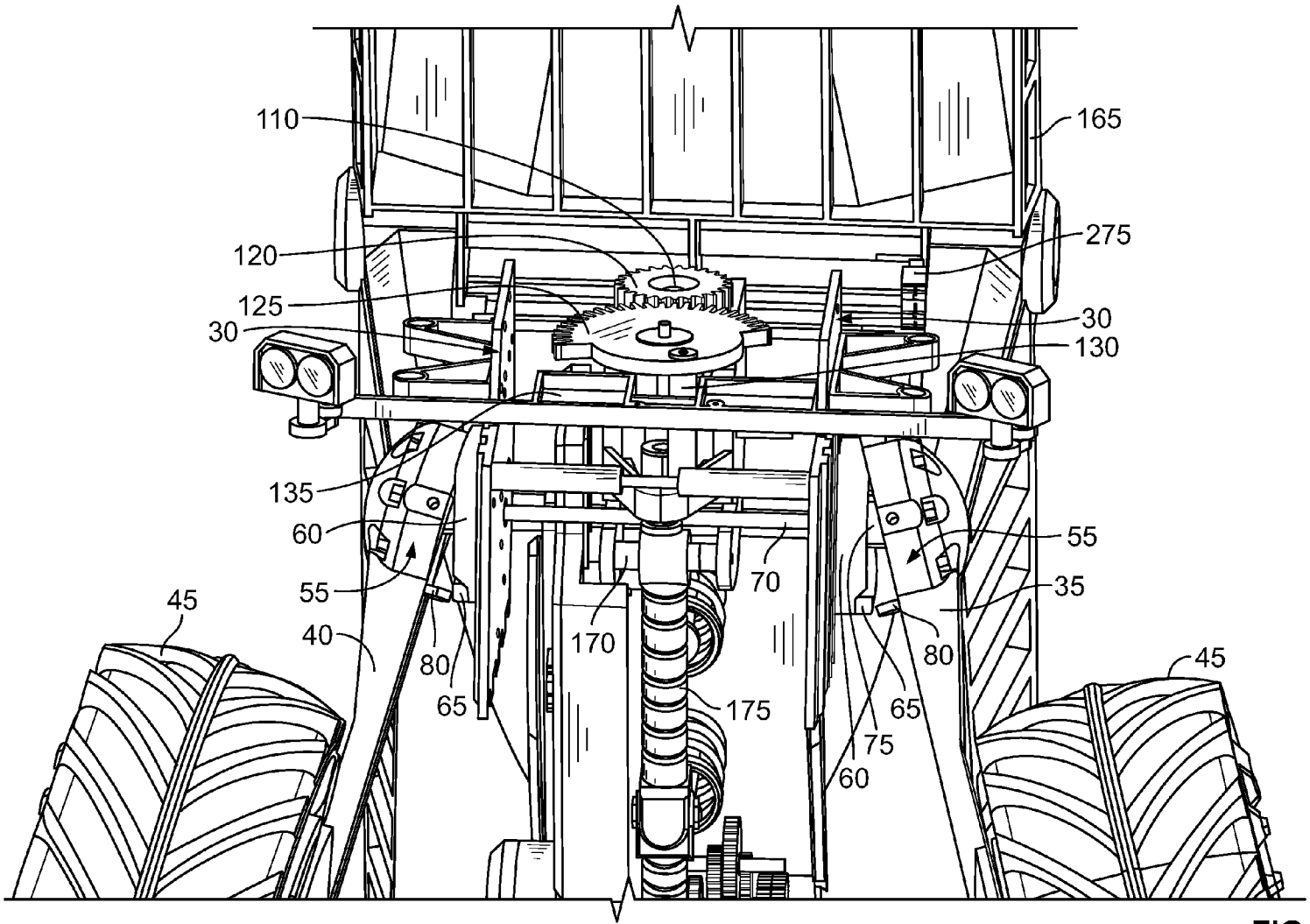
FIG. 3*b* is an enlarged front perspective view of the vehicle from FIG. 1 in accordance with one embodiment of the present invention illustrating a partial view of the cab assembly in a position above the horizontal position.
Figure 3C:
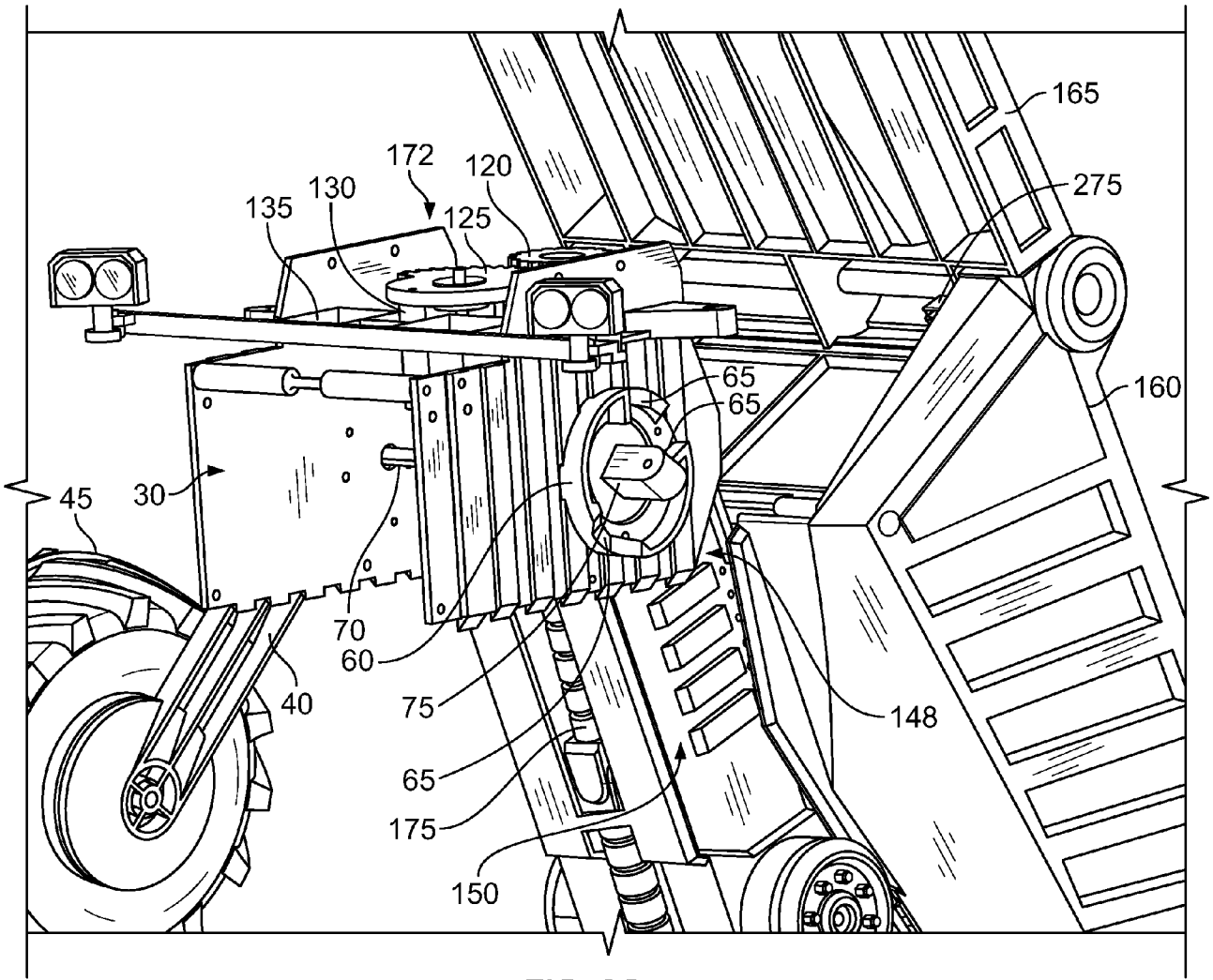
FIG. 3*c* is a detailed perspective view of components of the cab assembly from FIG. 3*a* and where the outer shell of the cab assembly and a left arm are removed.

Referring now to FIGS. 3*a* through 3*c* the vehicle is illustrated has having a cab assembly 28 in an a position above the horizontal position, which may include an angled position defined between zero and 180 degrees. The cab assembly 28 includes a cab housing 30, a left arm 35 and a right arm 40. Two wheels 45 are rotatably attached to a lower portion of each arm, such that each wheel may spin freely. An upper portion of each arm is rotatably attached to the cab housing via a joint 55. Each joint 55 includes an actuator 60 with slots 65 cut out of the outer rim of the actuator 60. A front axle 70 extends through holes in the cab housing 30 and connects to two flanges 75 on each end of the front axle 70. Each aim is connected to a flange 75 such that the arms pivot at the upper ends forward and backward as the front axle 70 rotates.

In addition to the forward and backward movement of the arms, the arms are capable of moving inward and outward in respect to the cab assembly 28. Joint 55 enables this arm movement by utilizing tabs 80 on an inside upper portion of each arm. When an arm pivots (further described below) the tabs 80 slide along the outer rim of the actuator 60. When the tabs 80 travel along the slots 65, the tabs 80 are directed up or down, depending on which portion of the slots 65 are pushing against the tabs 80. Consequently, the lower portions of the aims and the wheel are pivoted inward or outward.

Figure 3D:
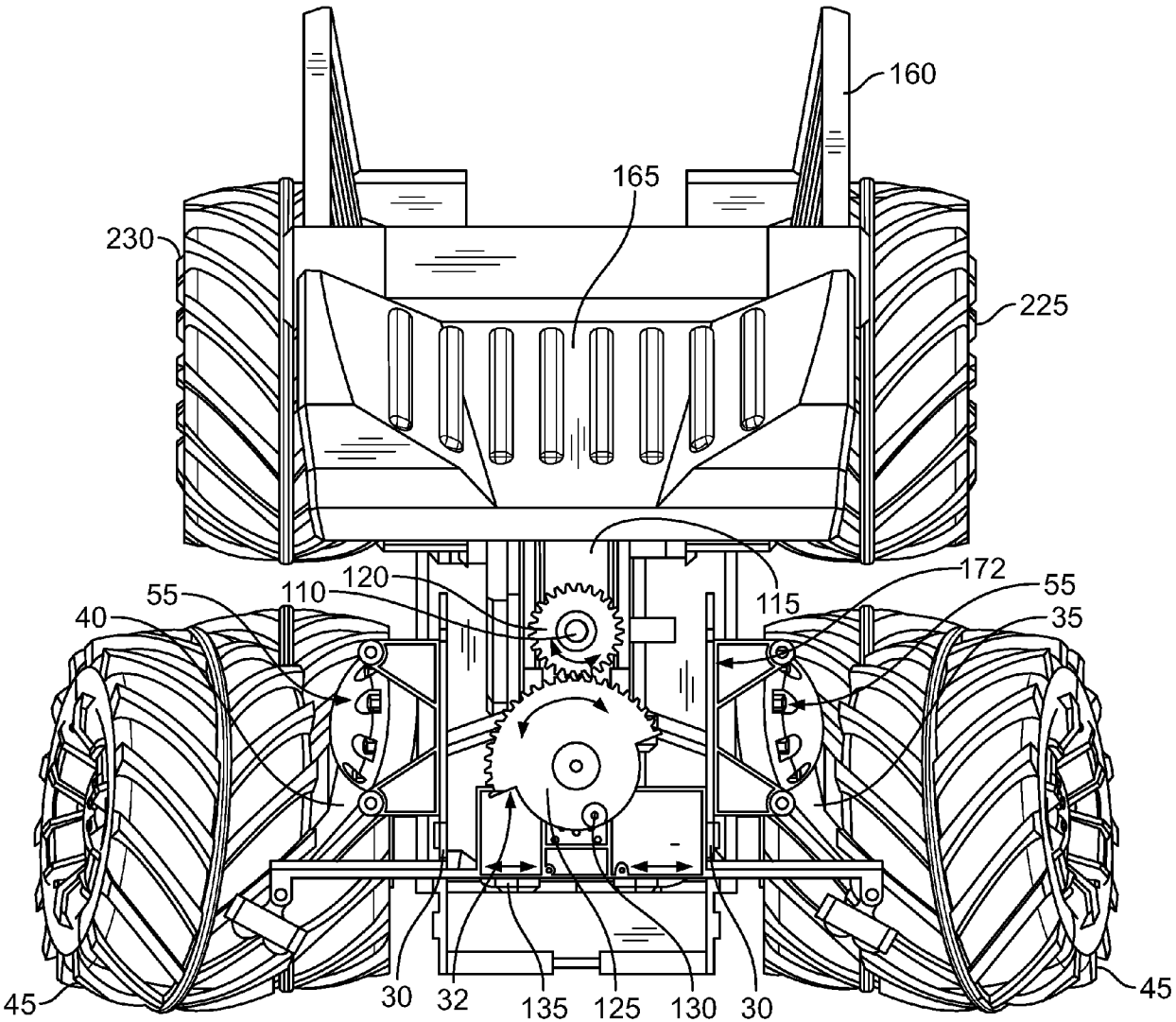
FIG. 3*d* is a top view of the vehicle from FIG. 1 illustrating a partial view of the cab assembly in a position above the horizontal position.

Referring also to FIG. 3*d*, a cab pivot mechanism 32 is housed within the cab housing 30 and includes a cab axle 110, a cab servo 115, a servo gear 120 and a cab gear 125. Cab servo 115 is vertically oriented relative to the cab housing 30 and is further meshed to the servo gear 120. The cab servo 115 drives the servo gear 120 to transfer rotation to the cab gear 125. Extending downward from the cab gear 125 is a shaft 130. As the cab gear rotates, the shaft 130 will come into contact with a plate 135 and will push plate 135 in the left or right direction. When the plate 135 contacts and pushes either side of the cab housing 30, the cab assembly rotates about an axis defined by the cab axle 110. Preprogrammed signals or a user input may determine the rotational direction of the cab assembly and is described in further detail below.

Figure 3E:
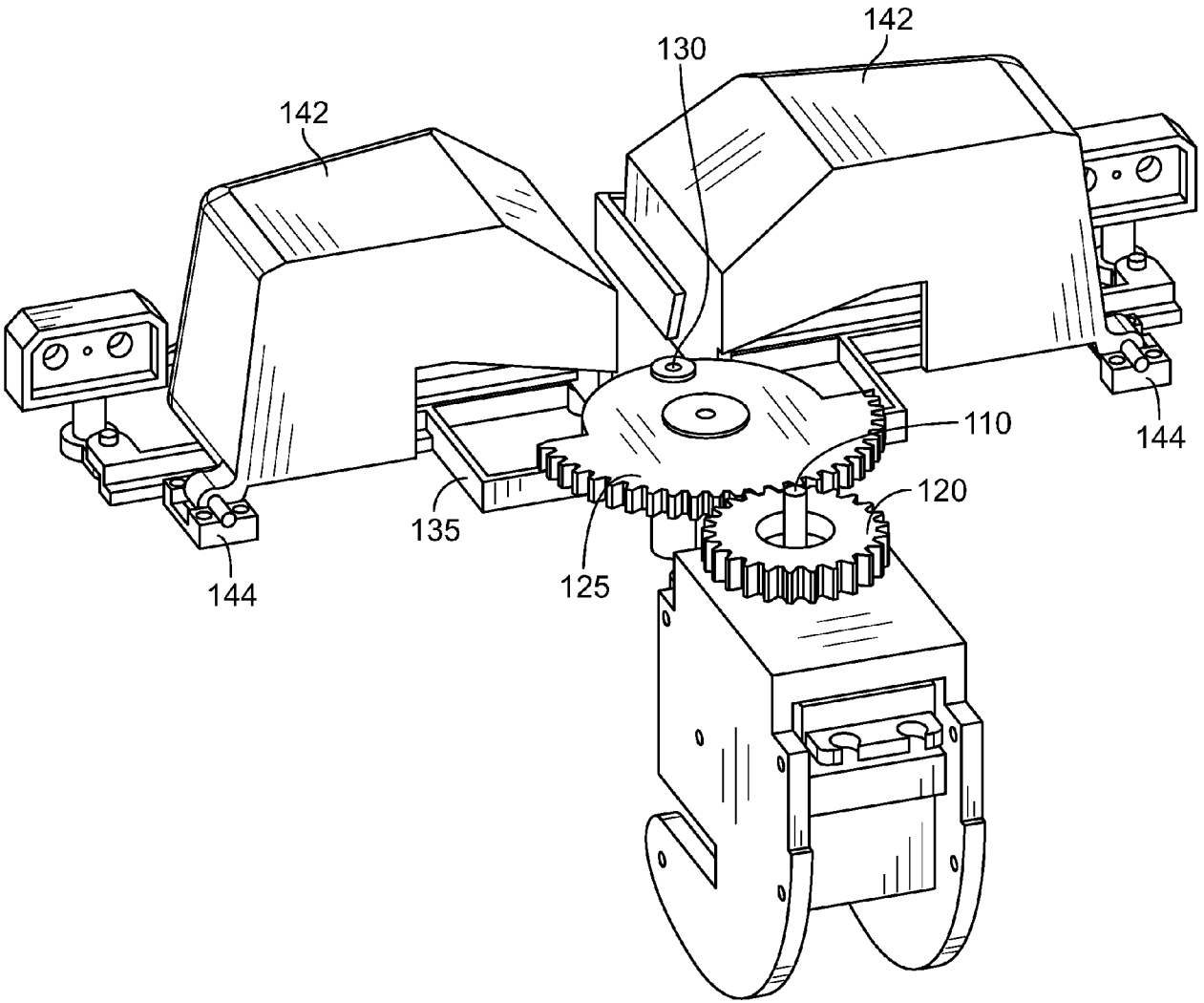
FIG. 3*e* is a rear perspective view illustrating the cab assembly and the relationship to the windshield eyes.
Figure 3F:
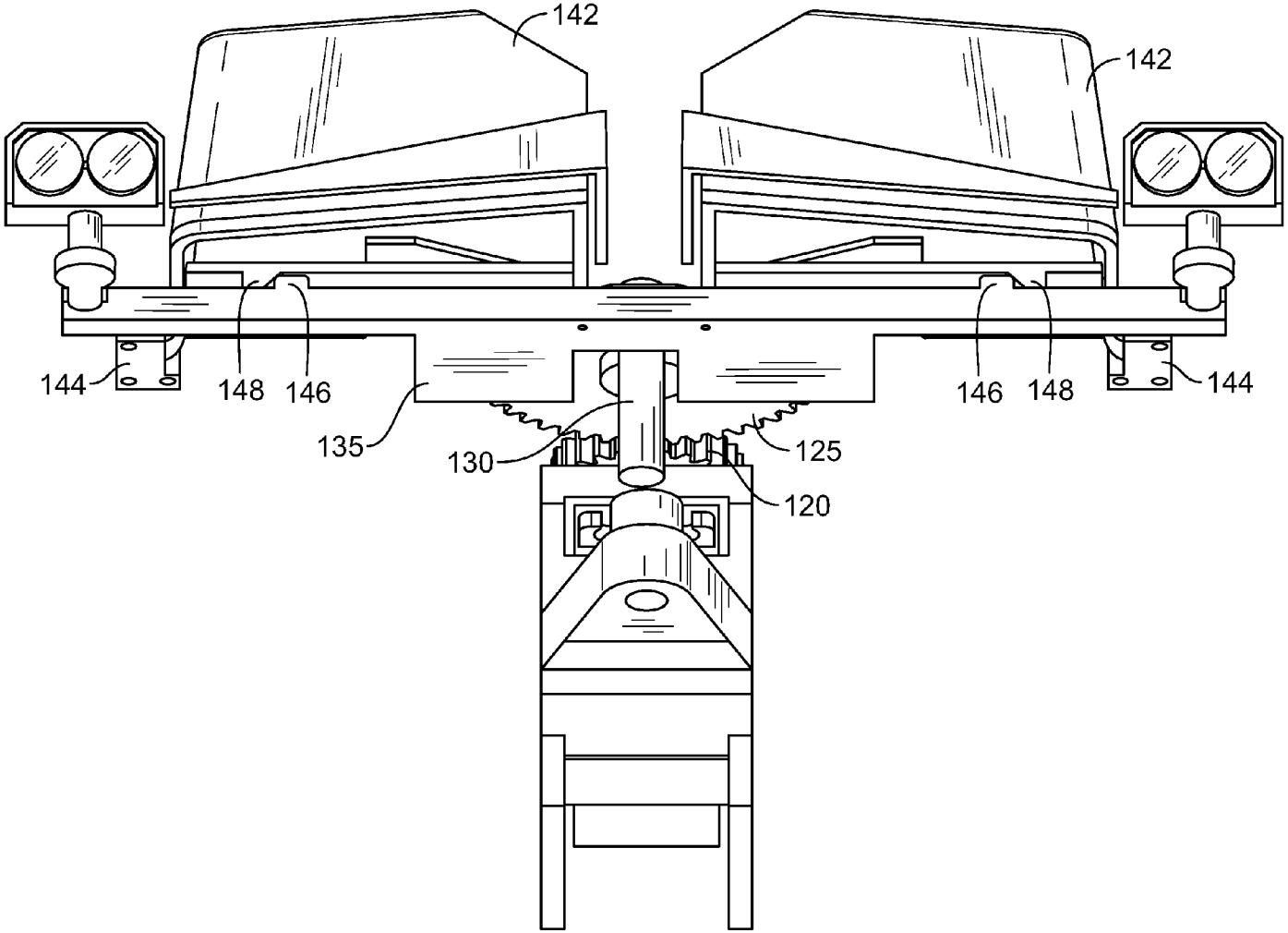
FIG. 3*f* is a lower front perspective view illustrating the cab assembly and the relationship to the windshield eyes.

Referring also not to FIGS. 3*e* and 3*f*, the vehicle includes two windshield eyes 142 that are pivotally mounted to the cab assembly 28. A pivot junction 144 is secured to the cab assembly 28 (while the cab assembly 28 is not shown in FIGS. 3*e* and 3*f*, it can be determined that the pivot junction 144 is easily secured to the cab assembly) such that the two windshield eyes 142 can pivot away from the movable plate 135. The mechanism that acts to move the two windshield eyes 142 is comprised of plate tabs 146 extending upwardly from the plate 135 and eye tabs 148 extending downwardly from the windshield eyes 142. The eye tabs 148 have an angled edge that comes into contact with a plate tab 146 as the plate is shifted either to the left or right. As the plate tab 146 makes contact and pushes against the angled edge of the eye tab 148, the eye tab 148 will ride up the plate tab such that the respective windshield eye pivots about the pivot junction 144.

Figure 4A:
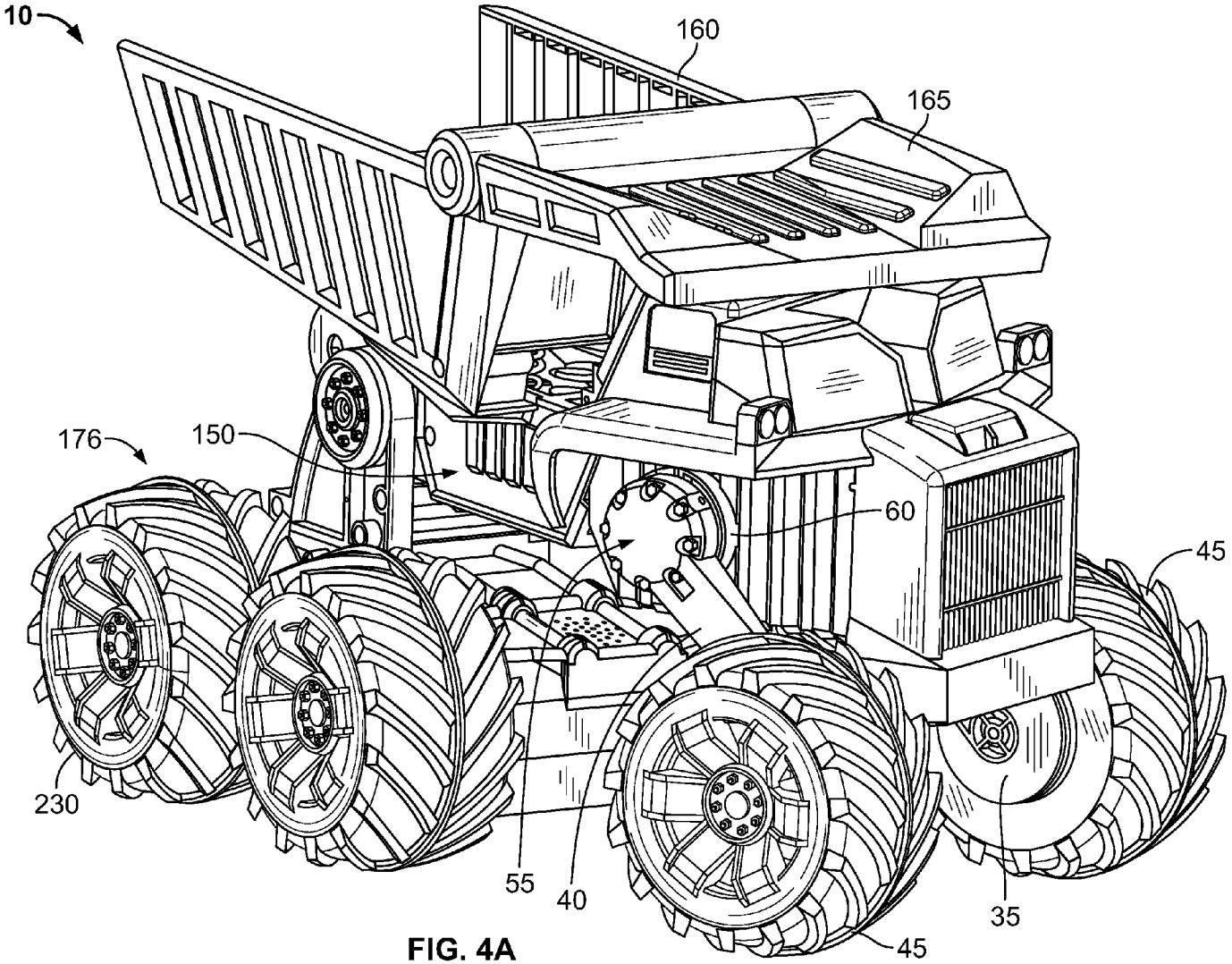
FIG. 4*a* is a front perspective view of the vehicle from FIG. 1 where the cab assembly is turned to the left.
Figure 4B:
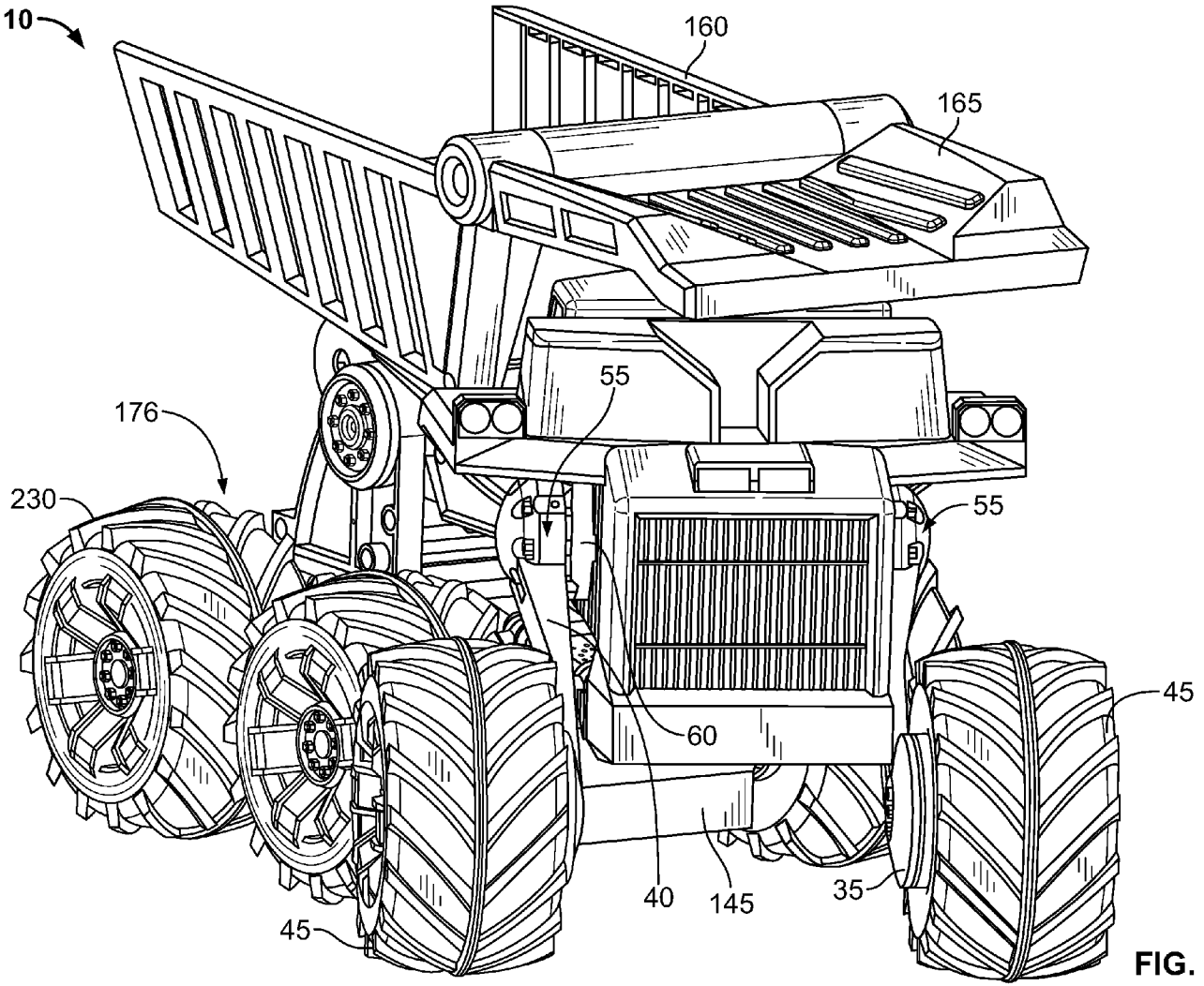
FIG. 4*b* is a front perspective view of the vehicle from FIG. 1 where the cab assembly is turned to the right.

Referring now to FIGS. 4*a* and 4*b*, the cab assembly 28 is illustrated as being turned to the left and right positions, respectively. Power is supplied to the cab servo 115 via wires running to a power source housed within the base housing 145. Those in the art will understand that while a servo is used as the cab servo 115 in this embodiment, alternative drive mechanisms may be used, such as a motor.

Figure 5A:
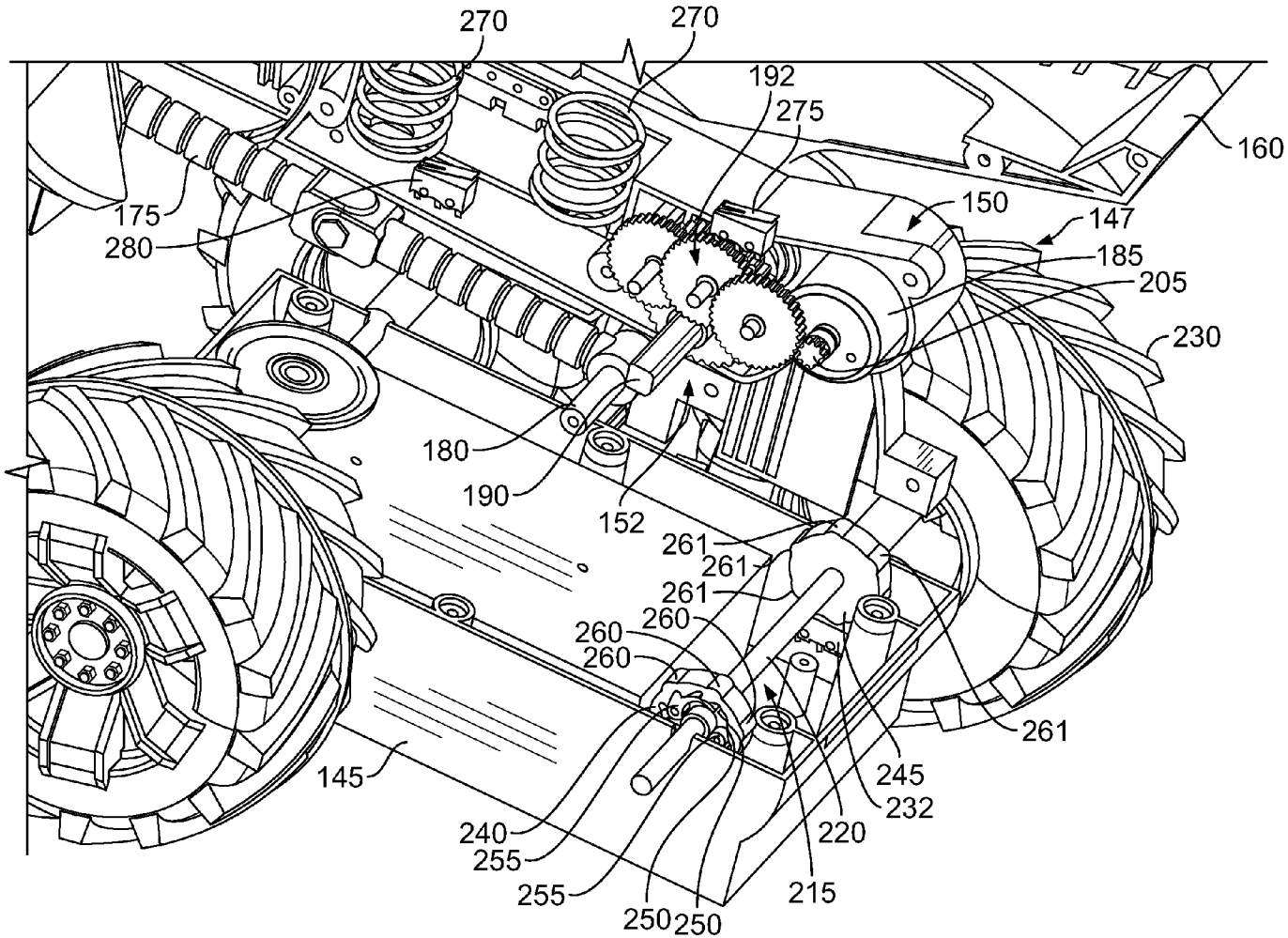
FIG. 5*a* is a rear perspective view of the vehicle from FIG. 1 where a portion of a base assembly is removed to show components of a chassis pivot mechanism.

A first linkage axle 170 (shown in FIG. 3*b*) rotatably attach the cab assembly 28 to one end of a chassis linkage 175 at an axis defined by the first linkage axle 170. The other end of the chassis linkage 175 is rotatably attached to a wheel base assembly 176 at a second linkage axle 180 (FIG. 5*a*). The axis of rotation being defined by the second linkage axle 180.

The wheel base assembly 176 includes the base housing 145, four wheels rotatably attached thereto and is further rotatably attached to a rear portion 167 of the chassis assembly 147 via the chassis pivot mechanism 152. While the embodiment illustrated includes four wheels rotatably attached to the base housing 145, those in the art will understand that a varying number of wheels may be used without departing from the scope of the present invention.

Figure 5B:
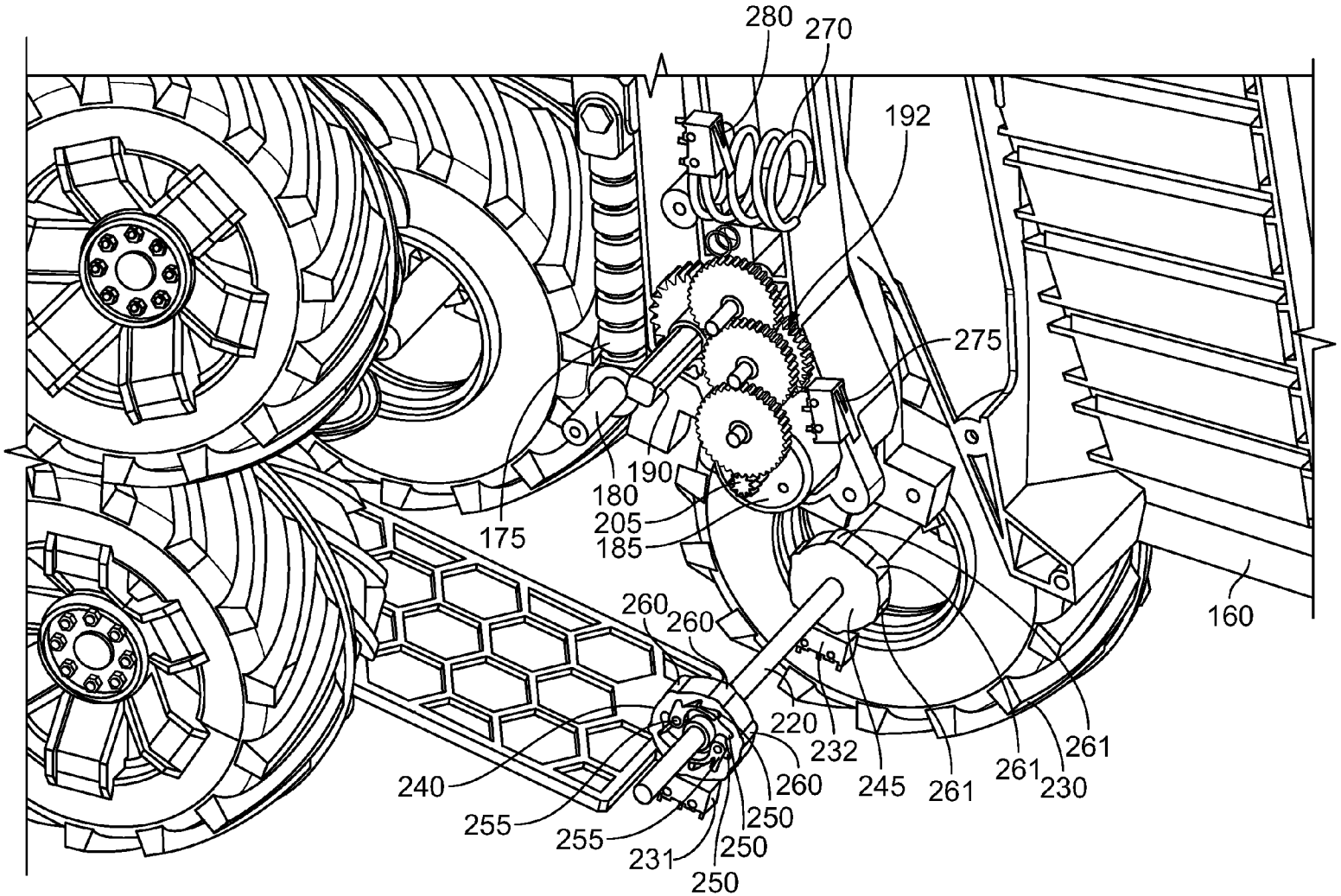
FIG. 5*b* is a detailed rear perspective view of the vehicle from FIG. 1 where a portion of a base housing and wheel are removed to show components the chassis pivot mechanism from FIG. 5*a* and a clutch mechanism and where the chassis assembly is raised to an a position above the horizontal position.
Figure 5C:
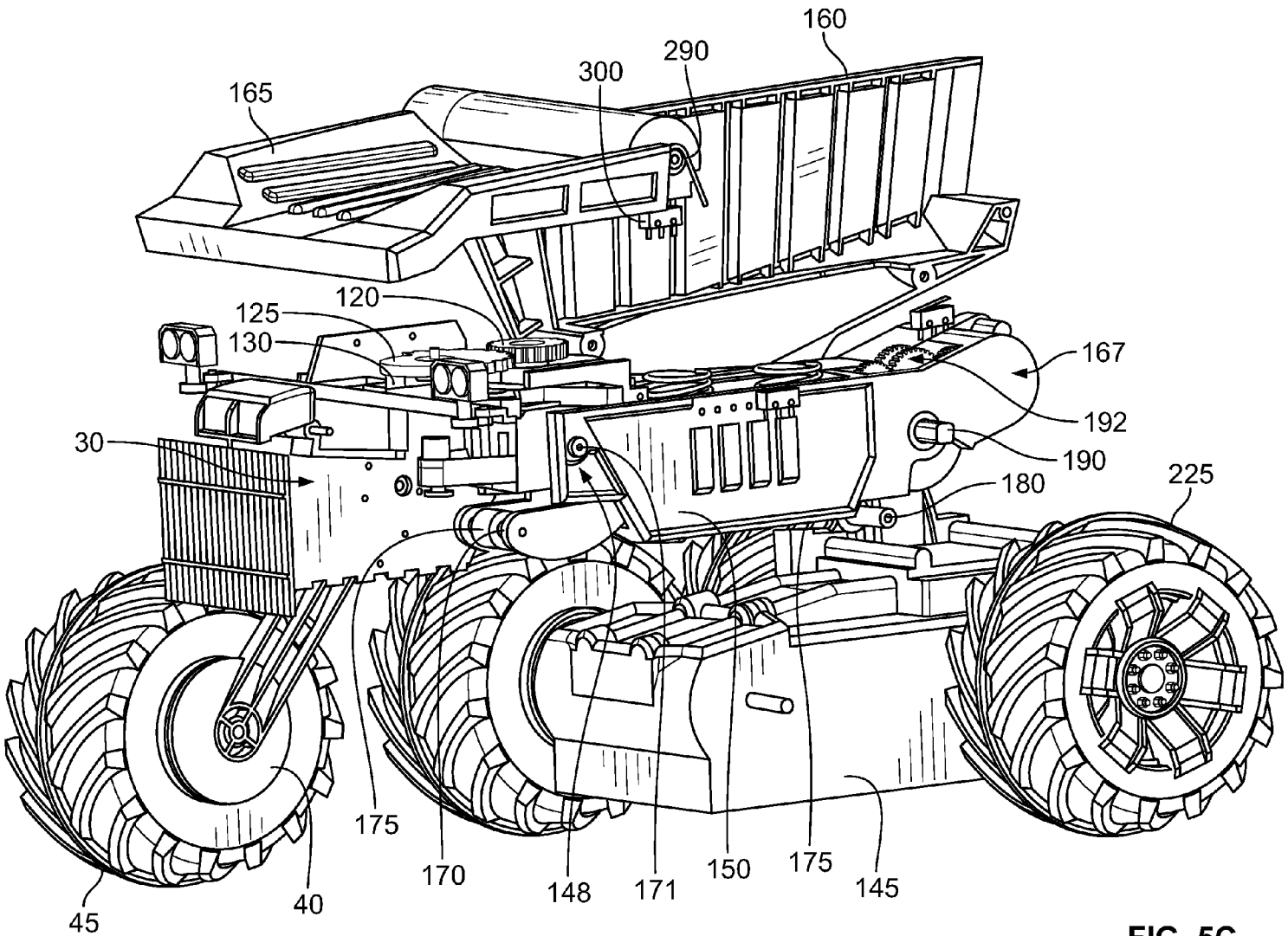
FIG. 5*c* is a front perspective view of the vehicle from FIG. 1 where a portion of the vehicle is removed to show internal components of the vehicle.

Referring now to FIGS. 5*a*-5*c*, the chassis assembly 147 includes the rear portion 167, a front portion 148, a chassis 150, a bed 160, and a bed overhang 165. A chassis pivot mechanism 152 facilitates the rotatable attachment of the rear portion 167 of the chassis assembly 147 and the wheel base assembly 176. The chassis pivot mechanism 152 includes a chassis motor 185, a chassis pivot axle 190, a chassis motor gear 191, a chassis gear train 192 and the chassis linkage 175. The chassis pivot axle 190 is horizontally oriented relative to the vehicle 10 and enables rotation of the chassis 150 about an axis defined by the chassis pivot axle 190. Additionally, a forward chassis axle 171 (FIG. 5*c*) rotatably attaches a rear portion 172 of the cab assembly 28 to the front portion 148 of the chassis assembly 147. The chassis linkage 175 freely rotates in parallel thereto, such that when the chassis pivot mechanism 152 rotates the chassis assembly 147 upward, the cab assembly 28 remains substantially horizontal.

Figure 6:
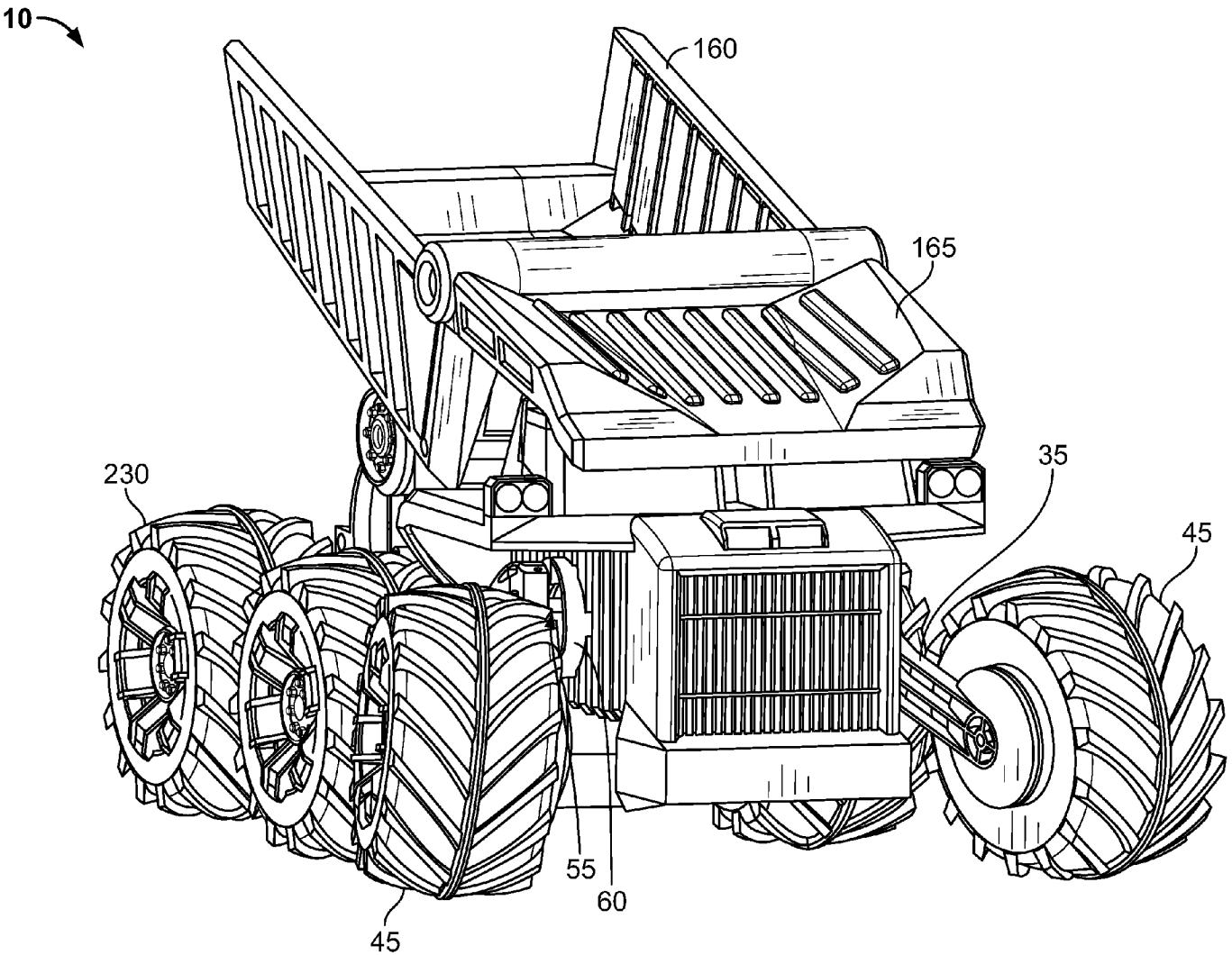
FIG. 6 is a front perspective view of the vehicle from FIG. 1 illustrating one of the positions of the vehicle truck bed.
Figure 7:
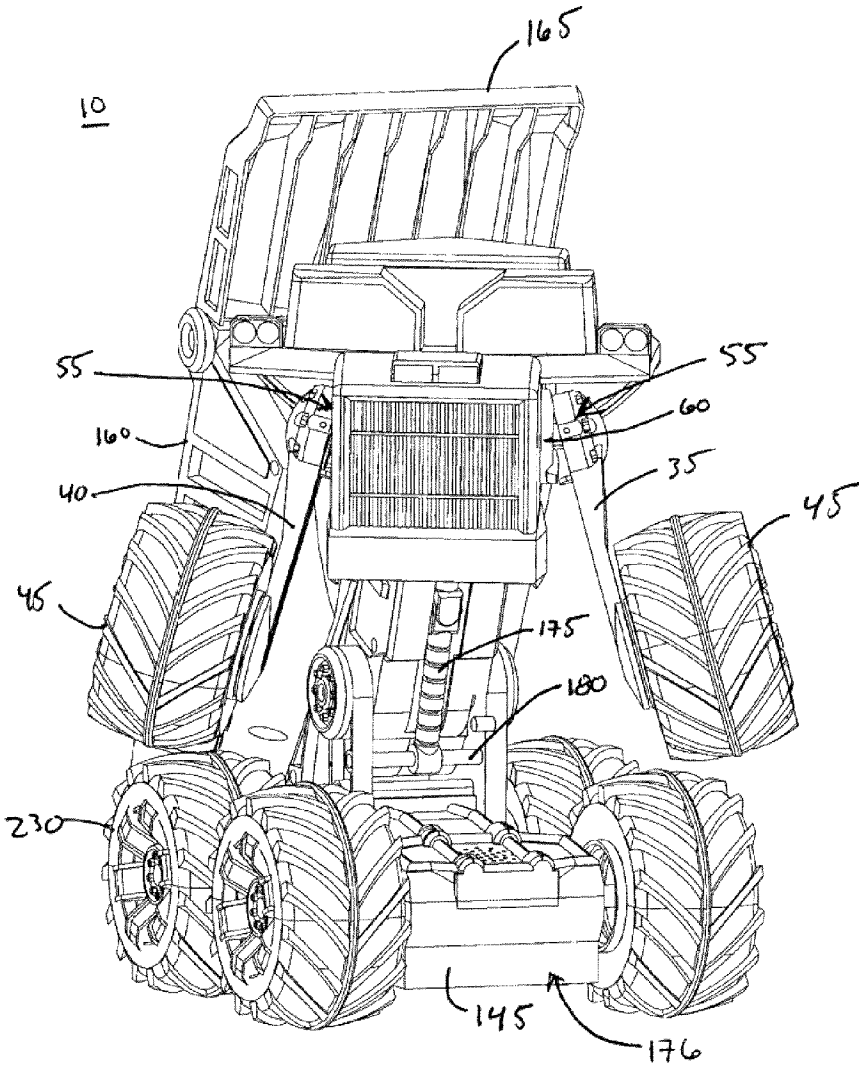
FIG. 7 is a front perspective view of the vehicle from FIG. 1 illustrating the cab assembly in a position above the horizontal position.

Rotation of the chassis pivot mechanism 152 is controlled by an integrated circuit ("IC," further described below). When the IC receives a signal from one of a plurality of switches (or from a remote control unit (not shown), the IC directs the chassis motor 185 via a control signal to activate in a direction to drive the front portion 148 of the chassis assembly 147 in either an upward or downward direction. Chassis motor 185 drives chassis motor gear 191 which in turn drives chassis gear train 192. The chassis gear train 192 is rotatably connected to the chassis pivot axle 190 such that the chassis pivot axle 190 rotates in accordance to the direction the chassis motor 185 is powered and the chassis assembly 147 moves accordingly. For example, FIG. 6 shows that chassis assembly 147 in a lowered position and FIG. 7 shows the chassis assembly 147 in the position above the horizontal position. As referenced above, these figures also show the inward and outward movement of the arms.

Referring now again to FIGS. 5*b*-5*c*, a clutch mechanism 215 is housed within the base housing 145. The clutch mechanism includes a rear axle 220, a left rear wheel 225, a right rear wheel 230, a left clutch switch 231 (FIG. 5*b*), a right clutch switch 232, a left clutch 240 and right clutch 245. Each clutch has a series of cutouts 250 to receive tabs 255. When the left rear wheel 225 moves in the forward direction, left clutch 240 engages tabs 255 to rotate the left clutch 240 in the forward direction. A series of bumps 260 on the outer rim of the left clutch 240 make contact with left clutch switch 231, triggering the transfer of a signal to the IC. When the right rear wheel 230 moves in the reverse direction, right clutch 245 engages tabs 255 to rotate the right clutch 245 in the reverse direction. A series of bumps 261 on the outer rim of the right clutch 245 make contact with the right clutch switch 232, triggering the transfer of a signal to the IC. When the tabs 255 are not engaged, the respective clutches are not engaged and thus do not rotate and trigger the respective switches. Either clutch may be configured to trigger a switch in accordance with both forward and reverse movements of the wheels. As further described below, the IC receives a signal and directs the activation of a preprogrammed response.

Figure 5D:
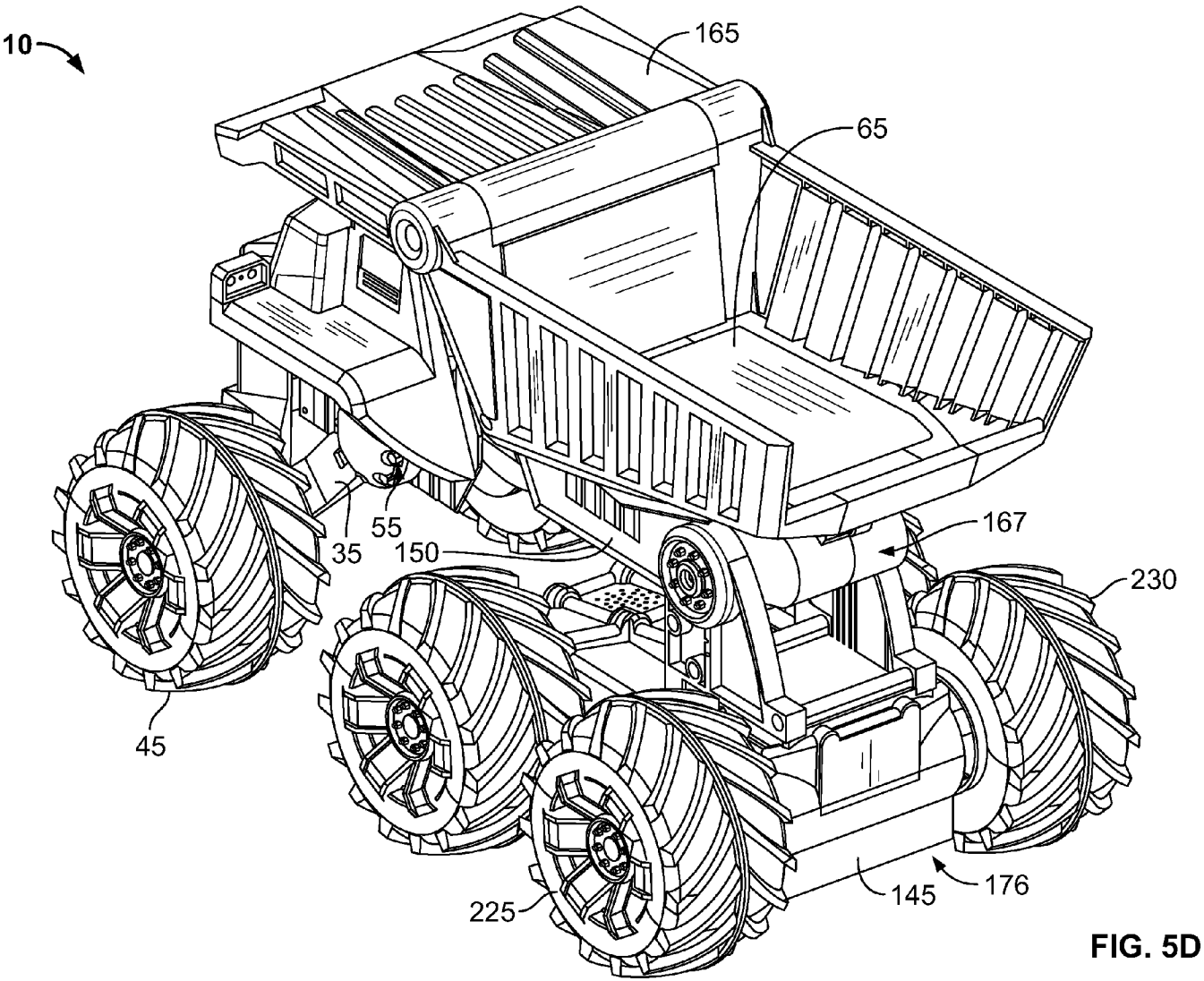
FIG. 5*d* is a rear perspective view of the vehicle from FIG. 1.

Now additionally referring to FIG. 5*d*, the bed 160 is secured to the chassis 150 while a bed plate 265 is secured to a set of springs 270 (FIG. 5*a*) housed within the chassis 150 such that the bed plate 265 may be pressed down and then return to a position flush with the interior of the bed 160. A switch 275 is positioned below the bed plate 265 such that the switch 275 triggers when the bed plate 265 is pressed. Thus, the bed plate 265 may also trigger switch 275 to send a signal to the IC when a load is placed on the bed plate 265. Two additional switches 280 (FIG. 5*b*) are further positioned below the bed 160 on each side. These switches 280 are triggered when the bed 160 is pressed in the left or right direction and triggers the transfer of a signal to the IC in accordance thereto. Upon receipt of a signal the IC may direct the activation of preprogrammed content. For example, and as shown previously in FIGS. 4*a* and 4*b*, the IC may direct the cab servo 115 to rotate the cab assembly to the left or right.

Referring now again to FIG. 5*c*, the bed overhang 165 is pivotally secured to the bed 160 at axis 285. The bed overhang 165 may rotate downward when pressed and returns to its original positioning via a spring 290. A switch 300 is positioned just below the bed overhang 165 such that the switch 300 is triggered when the bed overhang 165 is pressed downward. Similar to the response of the other switches, triggering switch 300 sends a signal to the IC and the IC may direct the chassis motor 185 to power and rotate the chassis assembly down to the lowered position described above.

Figure 8:
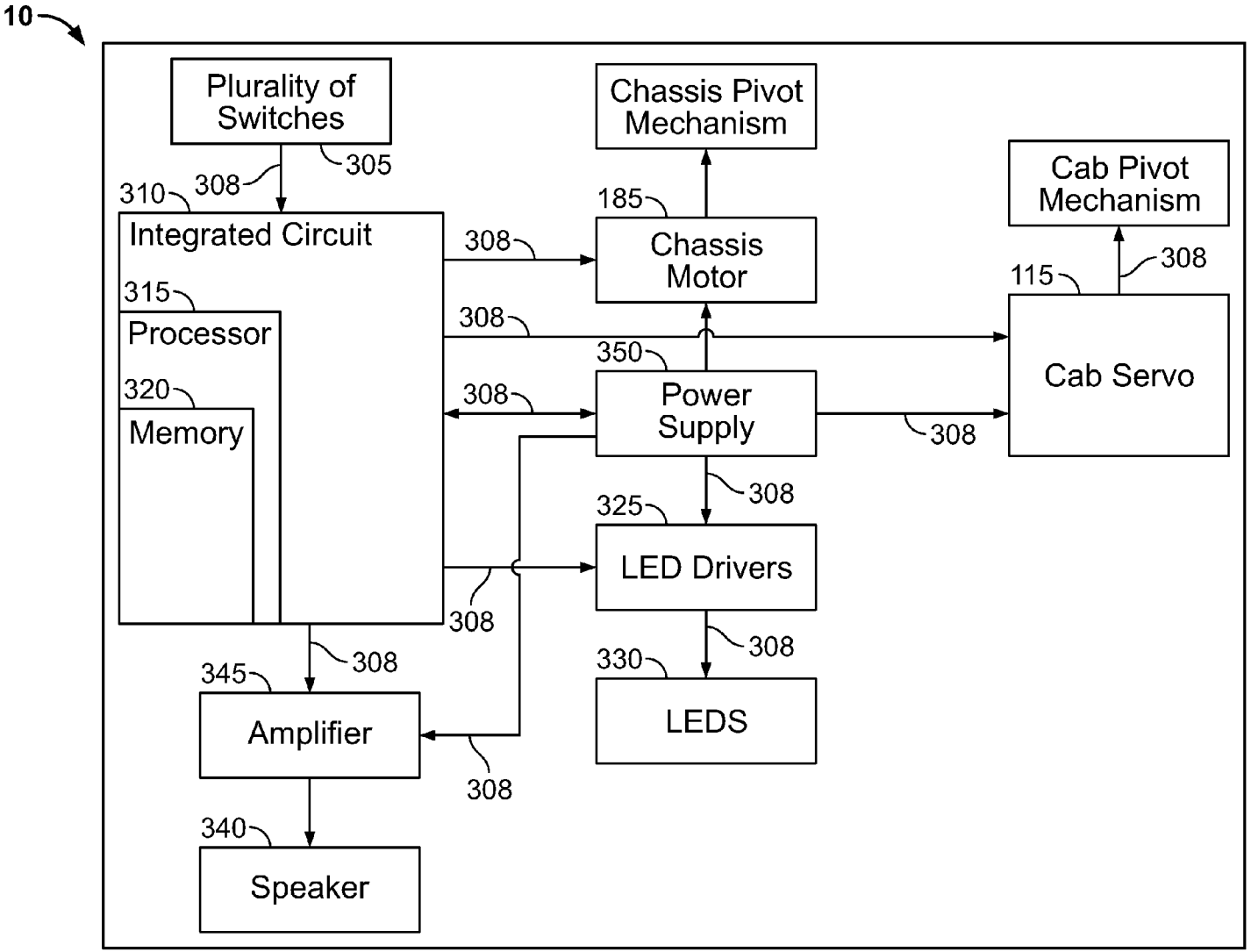
FIG. 8 is a block diagram of a vehicle made in accordance with an embodiment of the present invention.

Referring now to FIG. 8, there is shown a block diagram provided for an embodiment of the vehicles 10. When one of a plurality of switches 305 is triggered in response to a user's input or preprogrammed content, a signal is sent via an electrical connection 308 to an IC 310 included in the vehicle 10. The IC 310 contains a processor(s) 315 and a memory 320. The processor(s) 315 accesses preprogrammed signals or audio content stored on the memory 320 in the IC 310. The IC 310 further includes programming and electronic components to facilitate and direct audio content and control signals. The processor(s) 315 accesses the preprogrammed signals or audio content based on a program and/or in accordance to a user's input. The processor(s) 315 then generates a response that includes signals and may be in the form of audio or control signals. The IC 310 may be in communication with a variety of components, such as the cab servo 115, chassis motor 185, a set of LED drivers 325, or an amplifier 325. From the processor(s) 315 audio signals are transferred to the amplifier while control signals are transferred to the cab servo 115 and the chassis motor 185 to power in the desired direction, based on a program and/or in accordance to a preprogrammed response. Further, as the cab servo 115 or chassis motor 185 are powered, movement is transferred throughout the vehicle 10 as described herein. Additionally, signals may be transferred to the LED drivers 325 to illuminate a set of LEDs 330 included in the headlights. As a user triggers one or more of the plurality of switches 305, the vehicle 10 in response thereto may execute a performance pattern through movement and audio. Audio is played through the speaker 340 when the IC 310 sends audio content to the amplifier 345. A power source 350 is included in the vehicle 10 to supply power where necessary. It should further be contemplated that the vehicle 10 could include the capability for RC or IR control.

Examples of performance patterns that utilize movement and audio are below. Referring again to FIG. 1, the vehicle 10 is shown in the horizontal position. The chassis assembly and cab assembly may be raised or lowered via the chassis pivot mechanism at the direction of the IC 310 following receipt of a signal or signals indicating the triggering of one or more of the plurality of switches 305. When the chassis motor 185 receives a signal from the IC 310 directing chassis motor 185 to power and rotate the chassis assembly 20 downward, the chassis motor 185 drives the chassis gear train 210, directing the chassis pivot mechanism to rotate accordingly. As the chassis assembly lowers, the first linkage axle 170 and the horizontal cab axle 171 keep the cab assembly in a substantially horizontal position. Simultaneously, the lower portions of the left arm 35 and right arm 45 move the front wheels 45 forward and out as seen in FIG. 6. As described above, the tabs 80 and slots 65 relationship at the joints 55 of the left arm 35 and right arm 40 enable this outward motion. As the left arm 35 and right arm 40 are pushed forward, the tabs 80 at the upper portion of each arm engage the slots 65 in the corresponding actuators 60 within the joints 55 to push the arms outward.

To raise the vehicle 10 to the position above the horizontal position as shown in FIG. 7, the IC 310 directs chassis motor 185 to power and rotate the chassis assembly upward. While the chassis assembly rises, the cab assembly stays substantially horizontal, again, due to the location of the free pivots at the first linkage axle 170 and the forward chassis axle 192. Varying the degree of rotation of the chassis pivot mechanism in the upward and downward directions enables a variety of positions for the vehicle 10 to move between.

In the first embodiment, the vehicle 10 includes a means to pivot a chassis assembly in accordance to a variety of preprogrammed responses triggered by switches.

Further and in accordance with the first embodiment, the vehicle 10 includes a means to pivot a cab assembly in accordance to a variety of preprogrammed responses triggered by switches.

The first embodiment of the interactive vehicle 10 also includes a means to keep the cab assembly in a substantially horizontal position while the chassis assembly raises or lowers.

Additionally, the vehicle 10 includes a means to trigger preprogrammed movements of the components of the vehicle 10 while simultaneously outputting audio.

It is also important to note that the embodiments disclosed herein cover an vehicle 10 that utilizes preprogrammed content or direct user input to direct and trigger responses. It should be further noted that responses can be directed and triggered in a radio controlled embodiment utilizing a transmitter/receiver for communication from a user to the IC.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

We claim:

1. A toy vehicle comprising:

a wheel base assembly having at least two pair of rear rotatable wheels;

a chassis assembly rotatably attached to the wheel base assembly about a horizontal rotation axis capable of raising and lowering the chassis assembly from a first position to a second position;

a cab assembly being pivotally attached to the chassis assembly such that the cab assembly remains in a substantially horizontal position when the chassis assembly raises and lowers the cab assembly;

a pair of arms, each arm having at one end a front rotatable wheel and being attached to the cab assembly at an other end by a means to direct movement of said two arms when the chassis assembly raises and lowers the cab assembly; and wherein raising and lowering the cab assembly transforms the vehicle from the first position defined as a substantially horizontal position with the at least two pair of rear wheels and the front wheels attached to the arms being positioned for rotating on a surface to a second position defined as a position above the horizontal position with the at least two pair of rear wheels being positioned for rotating on a surface and the front wheels attached to the arms being raised above said at least two pair of rear wheels.

2. The vehicle of claim 1, wherein said means to direct movement of the two arms further comprising:

an upper portion on each arm rotatably attached to the cab assembly via a joint;

each aim including tabs positioned at an inside upper portion of the arm that slide along an outer rim of an actuator included in the joint, the outer rim further having slots such that when the tabs slide along the outer rim and into the slots, the tabs are directed upward or downward;

wherein the upward or downward movement of the tabs directs the lower portions of the arms to pivot inward or outward in accordance thereto.

3. The vehicle of claim 2, the vehicle further comprising:

the rotatable attachment of the chassis assembly and the wheel base including a chassis pivot axle and a means to rotate the chassis assembly about the chassis pivot axle;

the rotatable attachment of the chassis assembly and the cab assembly including at least one horizontal axle that directs the cab assembly to remain in a substantially horizontal position when the cab assembly raises.

4. The vehicle of claim 3, wherein said means to rotate the chassis assembly about the chassis pivot axle further includes a first motor driving a first gear train meshed to the chassis pivot axle, such that activating the motor drives the chassis pivot axle to raise or lower the cab assembly;

wherein the rotatable attachment of the chassis assembly and cab assembly further includes a means to pivot the cab assembly left and right defined by having a second motor driving a second gear train meshed to a cab axle, such that activating the second motor drives the cab axle to pivot the cab assembly left and right.

5. The vehicle of claim 4, wherein the vehicle further comprising:

said chassis pivot mechanism and said cab pivot mechanism in communication with a triggering means;

an integrated circuit with electronics for receiving signals generated in response to the triggering means and for controlling movement of the vehicle in response to the signals;

the first motor in communication with said triggering means and linked to control movement of the chassis pivot mechanism such that the chassis pivot mechanism moves in response to a first activation of the triggering means;

the second motor in communication with said triggering means and linked to control movement of the cab pivot mechanism such that the cab pivot mechanism moves in response to a second activation of the triggering means; and wherein said triggering means includes a third activation to simultaneously direct movement of the chassis pivot mechanism and the cab pivot mechanism.

6. The vehicle of claim 5, wherein the multiple configurations includes a first configuration resembling a vehicle and a second configuration resembling a character.

7. The vehicle of claim 6, wherein the vehicle further includes:

a circuit board in communication with the triggering means and a receiver; and a remote control unit with a transmitter to send commands to the receiver, such that the circuit board can send control signals to the triggering means to initiate the first activation, second activation, and/or the third activation to direct movement of the vehicle.

8. A transforming toy vehicle comprising:

multiple configurations including a first configuration and a second configuration;

a cab assembly including a cab pivot mechanism with a means to pivot the cab assembly from a center position to both left and right positions;

a wheel base assembly;

a chassis assembly rotatably attached to the wheel base assembly about a chassis pivot mechanism, the chassis pivot mechanism having a means to raise a front portion of the chassis assembly about a chassis pivot axle;

the cab pivot mechanism further connecting a rear portion of the cab assembly to the front portion of the of the chassis assembly, the chassis pivot mechanism rotatably connecting a rear portion of the chassis assembly to the wheel base assembly;

the first configuration defined by the chassis assembly and cab assembly positioned in a substantially horizontal position;

a means to direct the chassis pivot mechanism to raise the front portion of the chassis assembly while the cab pivot mechanism directs the cab assembly to retain a substantially horizontal position as the front portion of the chassis assembly rises to a position above the horizontal position defining the second configuration;

said chassis pivot mechanism and said cab pivot mechanism in communication with a triggering means;

an integrated circuit with electronics for receiving signals generated in response to the triggering means and for controlling movement of the vehicle in response to the signals;

a first motor in communication with said triggering means and linked to control movement of the chassis pivot mechanism such that the chassis pivot mechanism moves in response to a first activation of the triggering means; and a second motor in communication with said triggering means and linked to control movement of the cab pivot mechanism such that the cab pivot mechanism moves in response to a second activation of the triggering means;

wherein said triggering means includes a third activation to simultaneously direct movement of the chassis pivot mechanism and the cab pivot mechanism.

9. The vehicle of claim 8, wherein said means to raise the front portion of the chassis assembly further includes a first gear train meshing a first motor to the chassis pivot axle, such that powering the first motor drives the chassis pivot axle to raise or lower the chassis assembly and cab assembly rotatably attached thereto.

10. The vehicle of claim 9, wherein said means to pivot the cab assembly further comprises:

a second gear train meshing a second motor to a cab axle, such that powering the second motor drives the cab axle to pivot the cab assembly left and right.

11. The vehicle of claim 10, wherein said cab assembly further comprises:

two arm components rotatably attached at one end to the cab assembly, each arm component including a wheel rotatably attached at the other end;

the rotatable attachment of the arm components to the cab assembly including a joint to direct movement of the arm components in accordance to the positioning of the cab assembly; and each arm including tabs positioned at an inside upper portion of the arm that slide along an outer rim of an actuator included in the joint, the outer rim further having slots such that when the tabs slide along the outer rim and into the slots, the tabs are directed upward or downward;

wherein the upward or downward movement of the tabs directs the lower portions of the arms and wheels to pivot inward or outward in accordance thereto.

12. The vehicle of claim 11, wherein said first configuration resembles a vehicle and said second configuration resembles a character.

13. The vehicle of claim 12, wherein said triggering means directs movement of the cab pivot mechanism and the chassis pivot mechanism to transform the vehicle from the first configuration to the second configuration.

14. The vehicle of claim 13, wherein the vehicle further includes:

a receiver in communication with the integrated circuit and the triggering means; and a remote control unit with a transmitter to send commands to the receiver, such that the circuit board can send control signals to the triggering means to initiate the first activation, second activation, and/or the third activation to direct movement of the vehicle.

15. A transformation assembly for a toy vehicle comprising:

a wheel base assembly;

a chassis assembly rotatably mounted to the wheel base assembly about a horizontal rotation axis to raise and lower the chassis assembly from a substantially horizontal position to a position above the horizontal position;

a cab assembly being pivotally mounted to the chassis assembly wherein the cab assembly is able to remain in a substantially horizontal position upon raising and lowering the chassis assembly; and wherein, raising and lowering the cab assembly transforms the vehicle from a first configuration defined by the substantially horizontal position to a second configuration defined by the position above the horizontal position.

16. The transformation assembly of claim 15, further comprising:

a chassis pivot mechanism including a first means to secure the chassis assembly and the wheel base assembly in a first configuration and a cab pivot mechanism including a second means to secure the chassis assembly and the cab assembly in said first configuration; and whereby releasing said first means to secure and said second means to secure directs the chassis assembly to raise the cab assembly to the position above the horizontal position while the cab pivot mechanism keeps the cab assembly substantially horizontal.

17. The transformation assembly of claim 16, wherein said chassis pivot mechanism includes a first axle at said rotation axis and a first gear train meshing a first motor to the first axle, such that powering the first motor drives the first axle to raise or lower the chassis assembly and the cab assembly rotatably attached thereto.

18. The transformation assembly of claim 17, wherein said cab pivot mechanism further includes a means to pivot the cab assembly from left to right about a vertical axle, and said means to pivot the cab assembly further includes a second gear train meshing a second motor to the vertical axle, such that powering the second motor drives the vertical axle to pivot the cab assembly left and right.

19. The transformation assembly of claim 18, further comprising:

said chassis pivot mechanism and said cab pivot mechanism in communication with a triggering means;

an integrated circuit with electronics for receiving signals generated in response to the triggering means and for controlling movement of the vehicle in response to the signals;

the first motor in communication with said triggering means and linked to control movement of the chassis pivot mechanism such that the chassis pivot mechanism moves in response to a first activation of the triggering means;

the second motor in communication with said triggering means and linked to control movement of the cab pivot mechanism such that the cab pivot mechanism moves in response to a second activation of the triggering means; and wherein said triggering means includes a third activation to simultaneously direct movement of the chassis pivot mechanism and the cab pivot mechanism.

20. The transformation assembly of claim 19, the cab assembly further including:

two arm components rotatably attached to the cab assembly, each arm component including a wheel rotatably attached at the other end;

the rotatable attachment of the arm components to the cab assembly including a joint to direct movement of the arm components in accordance to the positioning of the cab assembly; and each arm including tabs positioned at an inside upper portion of the arm that slide along an outer rim of an actuator included in the joint, the outer rim further having slots such that when the tabs slide along the outer rim and into the slots, the tabs are directed upward or downward;

wherein the upward or downward movement of the tabs directs the lower portions of the arms and wheels to pivot inward or outward in accordance thereto.

* * * * *